US010614751B2

(12) United States Patent
Lee et al.

(10) Patent No.: US 10,614,751 B2
(45) Date of Patent: Apr. 7, 2020

(54) METHOD FOR SETTING DRIVING VOLTAGE OF DISPLAY DEVICE

(71) Applicant: Samsung Display Co., Ltd., Yongin-si (KR)

(72) Inventors: Seong Min Lee, Asan-si (KR); Dong Jin Lee, Seoul (KR); Ju Kyung Jo, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/005,697

(22) Filed: Jun. 12, 2018

(65) Prior Publication Data

US 2019/0206305 A1 Jul. 4, 2019

(30) Foreign Application Priority Data

Dec. 29, 2017 (KR) ..... 10-2017-0184508

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2310/0243* (2013.01); *G09G 2310/0264* (2013.01); *G09G 2320/0233* (2013.01); *G09G 2330/028* (2013.01)

(58) Field of Classification Search
CPC ..... G09G 2320/0233
See application file for complete search history.

(56) References Cited

U.S. PATENT DOCUMENTS

2002/0190935 A1* 12/2002 Maeda ..... G09G 3/3225 345/76
2006/0001623 A1* 1/2006 Sung ..... G09G 3/3233 345/77
2017/0263198 A1* 9/2017 Zhu ..... G09G 3/3607

FOREIGN PATENT DOCUMENTS

KR 10-2015-0002195 1/2015
KR 10-2017-0066771 6/2017
KR 10-2017-0070299 6/2017

* cited by examiner

*Primary Examiner* — Robin J Mishler
(74) *Attorney, Agent, or Firm* — H.C. Park & Associates, PLC

(57) ABSTRACT

A method of setting a driving voltage of a display device including the steps of: measuring luminance of the display device; obtaining a color coordinate from the luminance of the display device and determining luminance efficiency with respect to the color coordinate; determining an initial value of the driving voltage with respect to the determined luminance efficiency; and determining an optimal driving voltage of the display device by using the determined initial value of the driving voltage.

18 Claims, 7 Drawing Sheets

METHOD FOR SETTING DRIVING VOLTAGE OF DISPLAY DEVICE

CROSS REFERENCE TO RELATED APPLICATION

This application claims priority from and the benefit of Korean Patent Application No. 10-2017-0184508, filed on Dec. 29, 2017, which is hereby incorporated by reference for all purposes as if fully set forth herein.

BACKGROUND

Field

Exemplary embodiments of the invention relate generally to a method of setting a driving voltage of a display device, and, more specifically, to a method of setting a driving voltage of a display device by using luminance of the display device.

Discussion of the Background

A display device includes a plurality of pixels for displaying an image, and the plurality of pixels include a light-emitting element, a plurality of transistors for operating the light emitting element, and the like. When the same data voltage is applied to the plurality of pixels, luminance or color of the plurality of pixels may vary depending on the characteristics of the light-emitting element, the plurality of transistors, and the like. Particularly, a luminance difference or a color difference may occur between display devices manufactured in the same process depending on the characteristics of elements therein.

In general, a process of setting a driving voltage of the display device during the manufacturing process of the display device is performed to minimize the luminance difference or the color difference, such that the display device may display accurate luminance and color. However, as a time required for setting the driving voltage of the display device increases, productivity of the display device decreases, and thus, it is necessary to reduce the time for setting the driving voltage of the display device.

The above information disclosed in this Background section is only for understanding of the background of the inventive concepts, and, therefore, it may contain information that does not constitute prior art.

SUMMARY

Exemplary embodiments of the present invention provide a method of setting a driving voltage of a display device that may efficiently set the driving voltage of the display device.

Additional features of the inventive concepts will be set forth in the description which follows, and in part will be apparent from the description, or may be learned by practice of the inventive concepts.

A method of setting a driving voltage of a display device according to an exemplary embodiment includes the steps of: measuring luminance of the display device; obtaining a color coordinate from the luminance of the display device and determining luminance efficiency with respect to the color coordinate; determining an initial value of the driving voltage with respect to the determined luminance efficiency; and determining an optimal driving voltage of the display device by using the determined initial value of the driving.

The color coordinate may be one of primary colors of the display device.

The luminance efficiency may be a ratio of the luminance of the display device to a current provided to the display device.

The step of determining the luminance efficiency with respect to the color coordinate may include determining a value of luminance efficiency in a luminance efficiency curve of the color coordinate as the luminance efficiency, the value of luminance efficiency corresponding to the obtained color coordinate.

The step of determining the initial value of the driving voltage with respect to the determined luminance efficiency may include determining the initial value of the driving voltage corresponding to the determined luminance efficiency from a driving voltage linear relationship, in which the driving voltage linearly increases as the luminance efficiency increases.

The step of determining the optimal driving voltage of the display device may include determining a test start driving voltage by using the determined initial value of the driving voltage, and searching the optimal driving voltage of the display device by measuring the luminance of the display device while adjusting the driving voltage applied to the display device from the test start driving voltage by a unit of an adjustment interval.

One of a plurality of candidate voltages that are settable as the optimal driving voltage may be selected as the test start driving voltage, and the selected test start driving voltage is greater than the initial value of the driving voltage and closest to the initial value of the driving voltage.

One of a plurality of candidate voltages that are settable as the optimal driving voltage may be selected as the test start driving voltage, and the selected test start driving voltage may be closest to the initial value of the driving voltage.

The display device may include a light-emitting diode configured to be applied with a first power voltage of a high level and a second power voltage of a low level, and the optimal driving voltage of the display device may be the second power voltage.

A method of setting a driving voltage of a display device according to another exemplary embodiment includes the steps of: measuring luminance of the display device; measuring a voltage and a current of an external power source supplying power to the display device; calculating luminance efficiency by using the measured luminance and the measured voltage and current; determining an initial value of the driving voltage with respect to the calculated luminance efficiency; and determining an optimal driving voltage of the display device by using the determined initial value of the driving voltage.

The step of measuring the voltage and current of the external power source comprises measuring a voltage and a current output from a battery of the display device.

The luminance efficiency may be a ratio of the luminance of the display device to a current provided to the display device.

The step of determining the initial value of the driving voltage with respect to the calculated luminance efficiency may include determining the initial value of the driving voltage corresponding to the calculated luminance efficiency from a driving voltage linear relationship, in which the driving voltage linearly increases as the luminance efficiency increases.

The step of determining the optimal driving voltage of the display device may include determining a test start driving voltage by using the determined initial value of the driving voltage, and searching the optimal driving voltage of the display device by measuring the luminance of the display device while adjusting the driving voltage applied to the display device from the test start driving voltage by a unit of an adjustment interval.

One of a plurality of candidate voltages that are settable as the optimal driving voltage may be selected as the test start driving voltage, and the selected test start driving voltage may be greater than the initial value of the driving voltage and closest to the initial value of the driving voltage.

One of a plurality of candidate voltages that are settable as the optimal driving voltage may be selected as the test start driving voltage, and the selected test start driving voltage may be closest to the initial value of the driving voltage.

The display device may include a light-emitting diode configured to be applied with a first power voltage of a high level and a second power voltage of a low level, and the optimal driving voltage of the display device may be the second power voltage.

A method of setting a driving voltage of a display device according to still another exemplary embodiment includes the steps of: determining an initial value of the driving voltage with respect to luminance efficiency, the luminance efficiency being a ratio of luminance of the display device to a current provided to the display device; determining a test start driving voltage by using the determined initial value of the driving voltage; and searching an optimal driving voltage of the display device by measuring the luminance of the display device while adjusting the driving voltage applied to the display device from the test start driving voltage by a unit of an adjustment interval.

The steps may further include measuring luminance of the display device, and obtaining a color coordinate from the luminance of the display device and determining the luminance efficiency with respect to the color coordinate.

The steps may further include measuring luminance of the display device, measuring a voltage and a current of an external power source supplying power to the display device, and calculating the luminance efficiency by using the measured luminance, voltage, and current.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
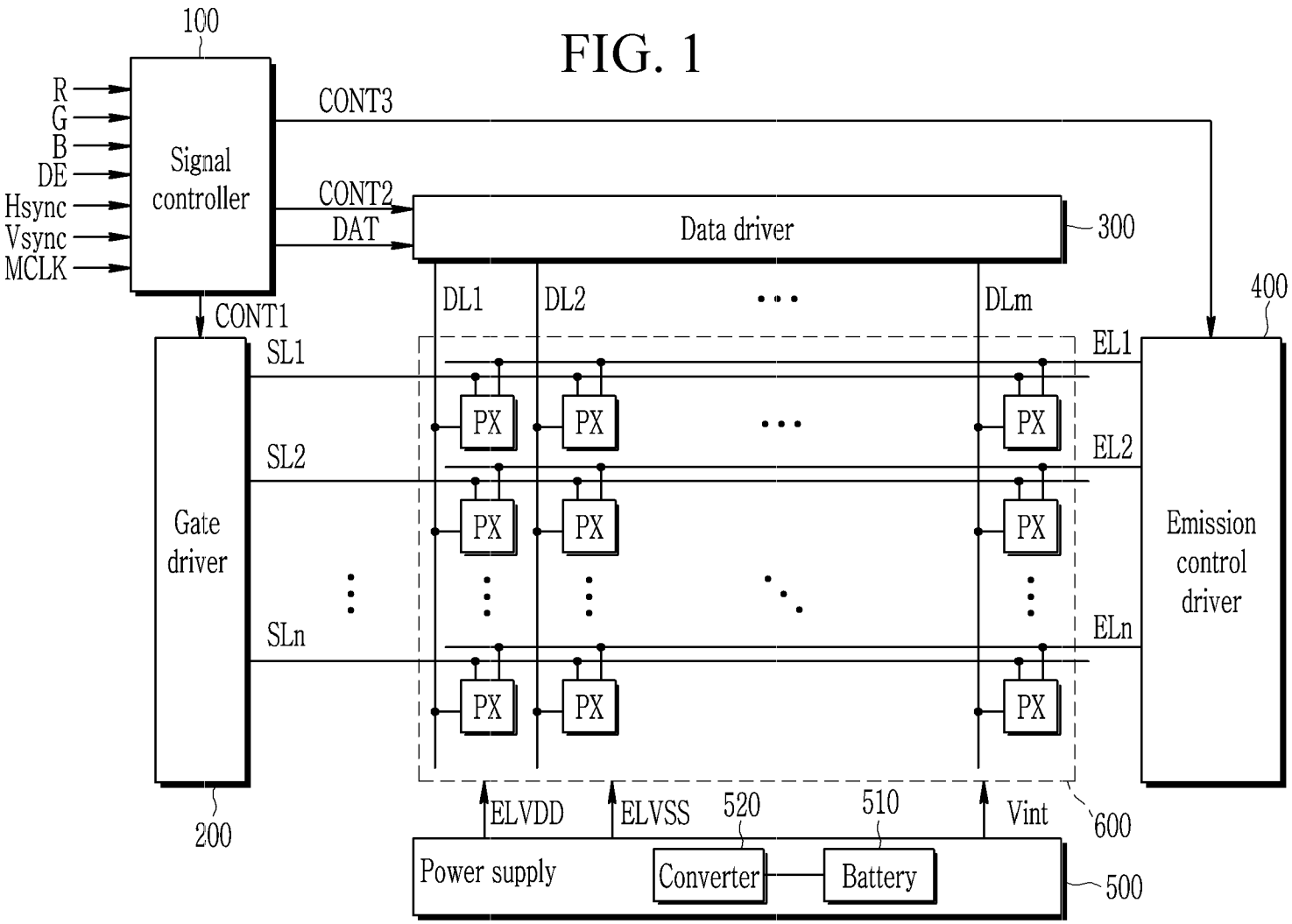
FIG. 1 is a block diagram of a display device according to an exemplary embodiment of the present invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, a display device according to an exemplary embodiment of the present invention will be described with reference to FIG. 1 and FIG. 2. FIG. 1 is a block diagram of a display device according to an exemplary embodiment of the present invention.

Referring to FIG. 1, a display device includes a signal controller 100, a gate driver 200, a data driver 300, an emission control driver 400, a power supply 500, and a display unit 600. The signal controller 100 receives image signals R, G, and B from an external device, and is an input control signal for controlling the display thereof. The image signals R, G, and B have luminance information for each pixel PX, and the luminance thereof has a predetermined gray levels. The input control signal, for example, includes a data enable signal DE, a horizontal synchronizing signal Hsync, a vertical synchronizing signal Vsync, and a main clock signal MCLK.

The signal controller 100 adjusts the input image signals R, G, and B based on the input image signals R, G, and B and the input control signal according to operating conditions of the display unit 600 and the data driver 300, and generates a gate control signal CONT1, a data control signal CONT2, an image data signal DAT, and an emission control signal CONT3. The signal controller 100 transmits the gate control signal CONT1 to the gate driver 200, transmits the data control signal CONT2 and the image data signal DAT to the data driver 300, and transmits the emission control signal CONT3 to the emission control driver 400.

The display unit 600 includes a plurality of gate lines (SL1-SLn), a plurality of data lines (DL1-DLm), a plurality of emission control lines (EL1-ELn), and a plurality of pixels PX. The plurality of pixels PX may be connected to the plurality of gate lines (SL1-SLn), the plurality of data lines (DL1-DLm), and the plurality of emission control lines (EL1-ELn) and substantially arranged in a matrix form. The plurality of gate lines (SL1-SLn) substantially extend in a row direction to be substantially parallel to each other. The plurality of emission control lines (EL1-ELn) substantially extend in a row direction to be substantially parallel to each other. The plurality of data lines (DL1-DLm) substantially extend in a column direction to be substantially parallel to each other.

The gate driver 200 is connected to the plurality of gate lines (SL1-SLn), and applies a gate signal including a gate-on voltage and a gate-off voltage according to the gate control signal CONT1 to the plurality of gate lines (SL1-SLn).

The data driver 300 is connected to the plurality of data lines (DL1-DLm), and generates a data voltage according to the image data signal DAT. The data driver 300 may apply the data voltage to the plurality of data lines (DL1-DLm) according to the data control signal CONT2.

The emission control driver 400 may be connected to the plurality of emission control lines (EL1-ELn), and may apply an emission control signal including a gate-on voltage and a gate-off voltage to the plurality of emission control lines (EL1-ELn) according to the emission control signal CONT3.

The power supply 500 provides a first power voltage ELVDD, a second power voltage ELVSS, and an initialization voltage Vint to the plurality of pixels PX. The first power voltage ELVDD may be a high level voltage provided to an anode electrode of a light-emitting diode LED included in each of the plurality of pixels PX. The second power voltage ELVSS may be a low level voltage provided to a cathode electrode of a light-emitting diode LED included in each of the plurality of pixels PX. The first power voltage ELVDD and the second power voltage ELVSS are driving voltages for causing the plurality of pixels PX to emit light.

In some exemplary embodiments, the power supply 500 may include a battery 510 and a converter 520 for converting a DC voltage of the battery 510 to a different level of DC voltage. The converter 520 may generate the first power voltage ELVDD, the second power voltage ELVSS, and the initialization voltage Vint by using the DC voltage of the battery 510. In some exemplary embodiments, the battery 510 may be omitted, and the converter 520 may receive an external AC voltage. In this case, the converter 520 may convert the AC voltage to generate the first power voltage ELVDD, the second power voltage ELVSS, and the initialization voltage Vint.

Figure 2:
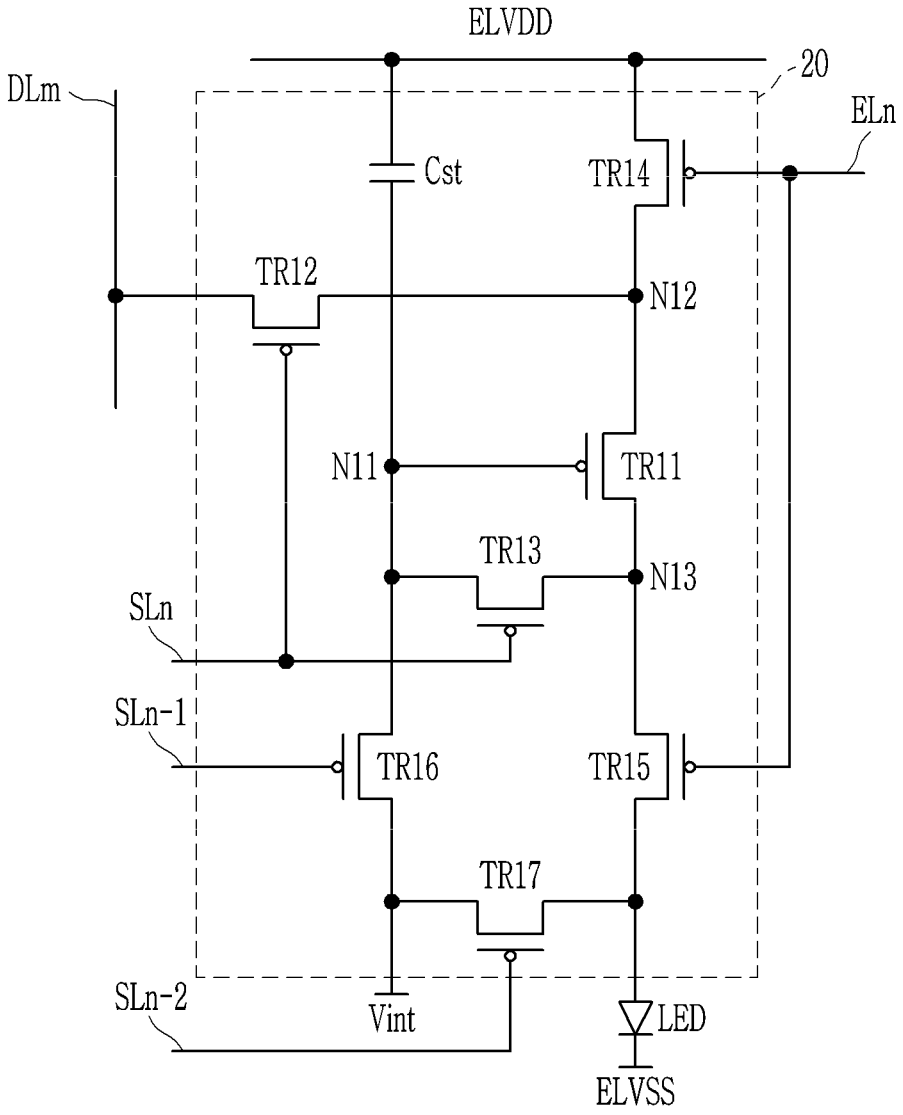
FIG. 2 is a schematic diagram of a pixel included in a display device according to an exemplary embodiment.

FIG. 2 is a schematic diagram of a pixel included in a display device according to an exemplary embodiment. A pixel PX disposed in an n-th pixel row and an m-th pixel column among the plurality of pixels PX included in the display device of FIG. 1 will be described as an example.

Referring to FIG. 2, the pixel PX includes a pixel circuit 20 for controlling the light emitting diode (LED) and a current flowing to the light-emitting diode LED. The pixel circuit 20 may include a driving transistor TR11, a switching transistor TR12, a compensation transistor TR13, a first emission control transistor TR14, a second emission control transistor TR15, a first initialization transistor TR16, a second initialization transistor TR17, and a storage capacitor Cst.

The driving transistor TR11 includes a gate electrode connected to a first node N11, a first electrode connected to a second node N12, and a second electrode connected to a third node N13. The driving transistor TR11 controls an amount of current flowing from the first power voltage ELVDD to the light-emitting diode LED in accordance with a voltage of the first node N11.

The switching transistor TR12 includes a gate electrode connected to a first gate line SLn, a first electrode connected to a data line DLm, and a second electrode connected to the second node N12. The switching transistor TR12 is turned on depending on a first gate signal of a gate-on voltage applied to the first gate line SLn to, and transmit a data voltage applied to the data line DLm to the second node N12.

The compensation transistor TR13 includes a gate electrode connected to the first gate line SLn, a first electrode connected to the third node N13, and a second electrode connected to the first node N11. The compensation transistor TR13 is turned on depending on the first gate signal of the gate-on voltage applied to the first gate line SLn to diode-connect the driving transistor TR11, thereby compensating a threshold voltage of the driving transistor TR11.

The first emission control transistor TR14 includes a gate electrode connected to an emission control line ELn, a first electrode connected to the first power voltage ELVDD, and a second electrode connected to the second node N12.

The second emission control transistor TR15 includes a gate electrode connected to the emission control line ELn, a first electrode connected to the third node N13, and a second electrode connected to the anode of the light-emitting diode LED. The first emission control transistor TR14 and the second emission control transistor TR15 are turned on depending on the emission control signal of the gate-on voltage applied to the emission control line ELn to allow a current flowing from the first power voltage ELVDD through the driving transistor TR11 to the light-emitting diode LED.

The first initialization transistor TR16 includes a gate electrode connected to a second gate line SLn-1, a first electrode connected to the initialization voltage Vint, and a second electrode connected to the first node N11. The first initialization transistor TR16 may be turned on depending on a second gate signal of a gate-on voltage applied to the second gate line SLn-1, and may transmit the initialization voltage Vint to the first node N11, thereby initializing the gate voltage of the driving transistor TR11.

The second initialization transistor TR17 includes a gate electrode connected to a third gate line SLn-2, a first electrode connected to the initialization voltage Vint, and a second electrode connected to the anode of the light-emitting diode LED. The second initialization transistor TR17 may be turned on depending on a third gate signal of the gate-on voltage applied to the third gate line SLn-2, and may transmit the initialization voltage Vint to the anode of the light-emitting diode LED, thereby initializing the light-emitting diode LED.

The storage capacitor Cst includes a first electrode connected to the first power voltage ELVDD and a second electrode connected to the first node N11. The data voltage compensated for the threshold voltage of the driving transistor TR11 is applied to the first node N11, and the storage capacitor Cst serves to maintain a voltage of the first node N11.

The light-emitting diode LED includes the anode connected to the second electrode of the second emission control transistor TR15 and the cathode connected to the second power voltage ELVSS. The light-emitting diode LED may be connected between the pixel circuit 20 and the second power voltage ELVSS to emit light having a luminance corresponding to a current provided from the pixel circuit 20. The light-emitting diode LED may emit light of one of primary colors or white light. The primary colors may be three primary colors, such as red, green, and blue. Alternatively, the primary colors may be yellow, cyan, magenta, etc.

Hereinafter, a display device will be described as having the three primary colors of red, green, and blue according to an exemplary embodiment.

When the same data voltage is applied to the plurality of pixels PX included in the display device, the luminance or color of the plurality of pixels PX may vary depending on the characteristics of the light-emitting diode LED or the plurality of transistors (TR11, TR12, TR13, TR14, TR15, TR16, and TR17) included in each pixel PX. Particularly, a luminance difference or a color difference may occur between display devices manufactured in the same process depending on the characteristics of elements therein. In general, a process of setting a driving voltage of the display device may be performed during the manufacturing process thereof to reduce the luminance difference or the color difference such that the display device may display accurate luminance and color. The process of setting the driving voltage of the display device may include adjusting at least one of the first power voltage ELVDD and the second power voltage ELVSS of the display device.

Hereinafter, a method of setting a driving voltage of a display device according to an exemplary embodiment will be described with reference to FIG. 3 to FIG. 8.

Figure 3:
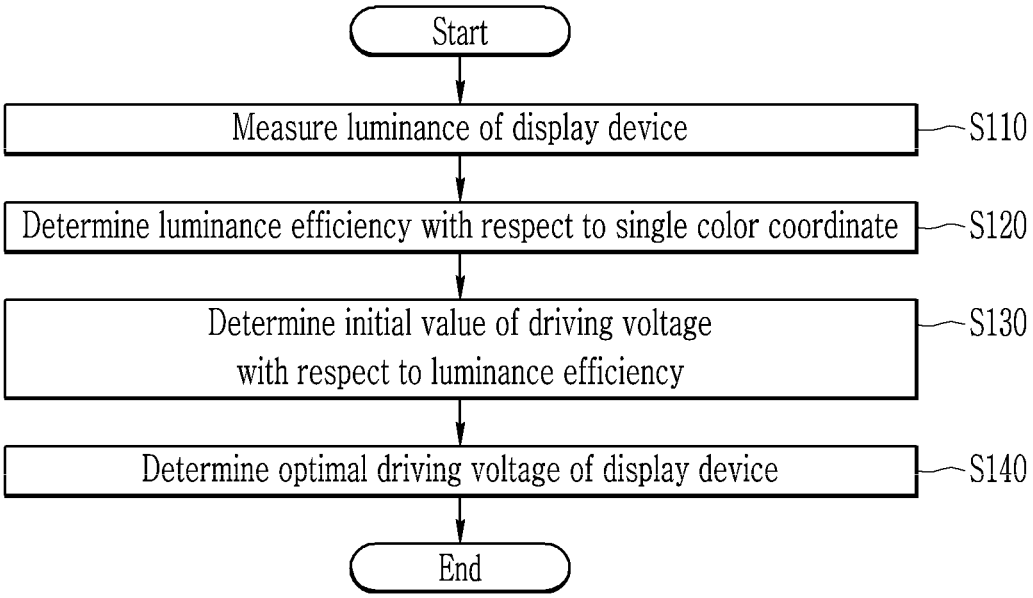
FIG. 3 is a flowchart of a method of setting a driving voltage of a display device according to an exemplary embodiment.
Figure 4:
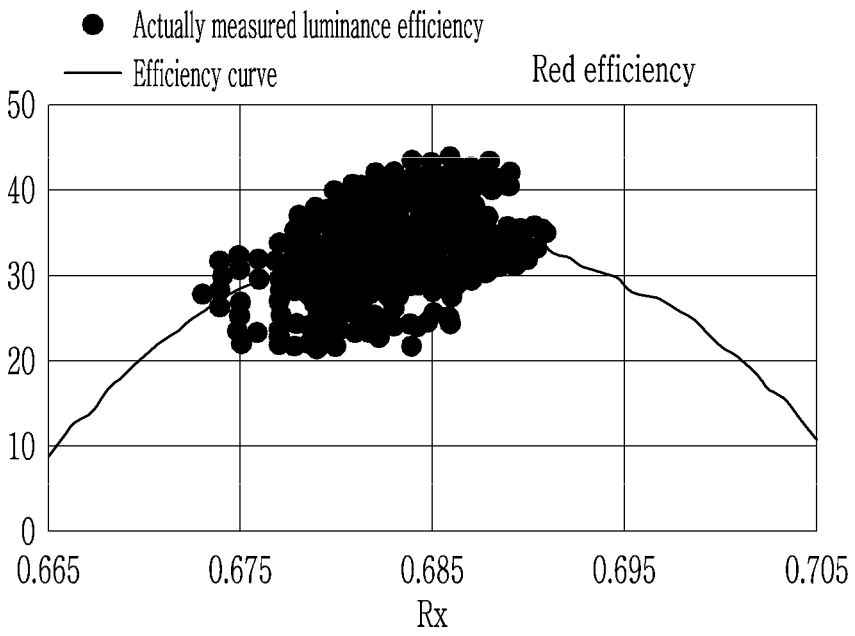
FIG. 4 is a graph of luminance efficiency for a red color coordinate according to an exemplary embodiment.
Figure 5:
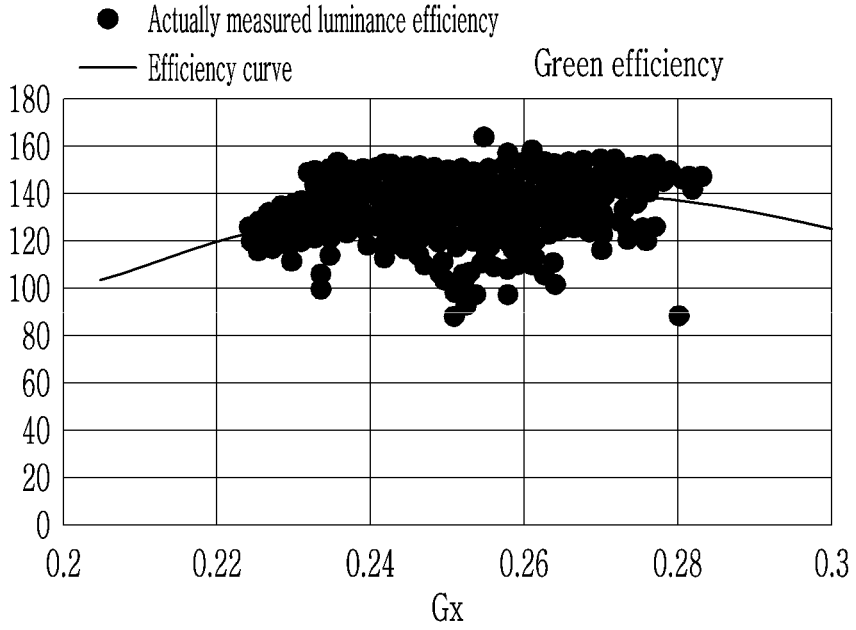
FIG. 5 is a graph of luminance efficiency for a green color coordinate according an exemplary embodiment.
Figure 6:
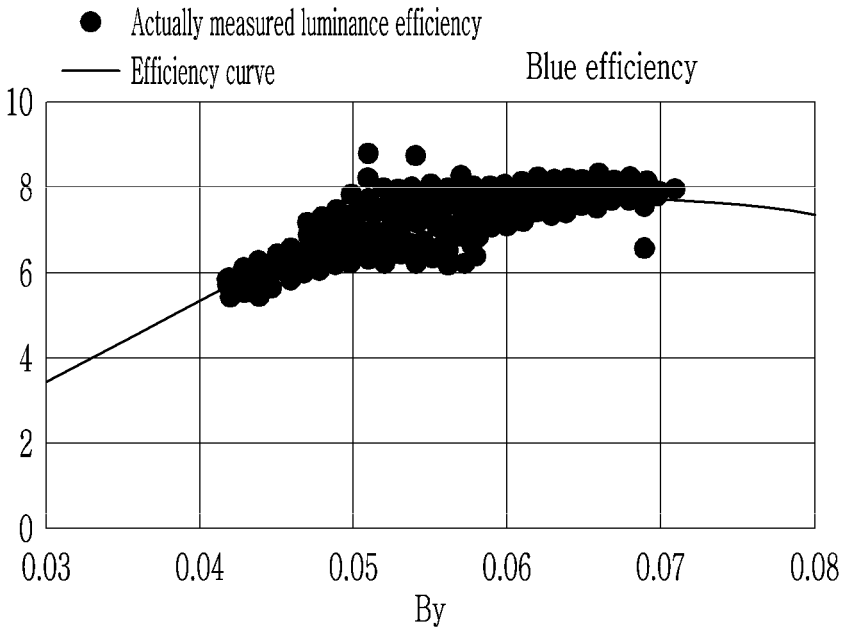
FIG. 6 is a graph of luminance efficiency for a blue color coordinate according to an exemplary embodiment.
Figure 7:
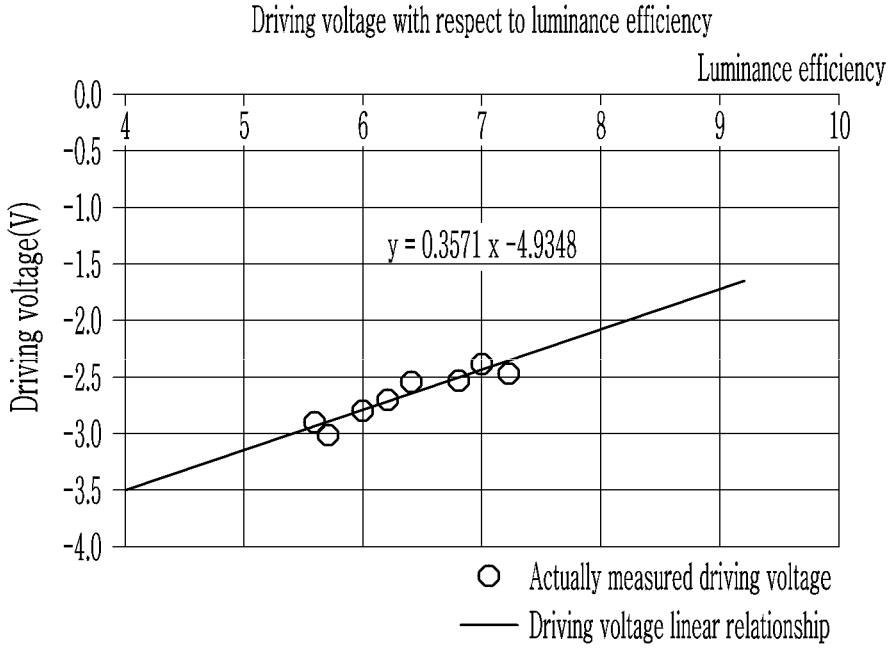
FIG. 7 is a relationship graph between luminance efficiency and driving voltages according to an exemplary embodiment.
Figure 8:
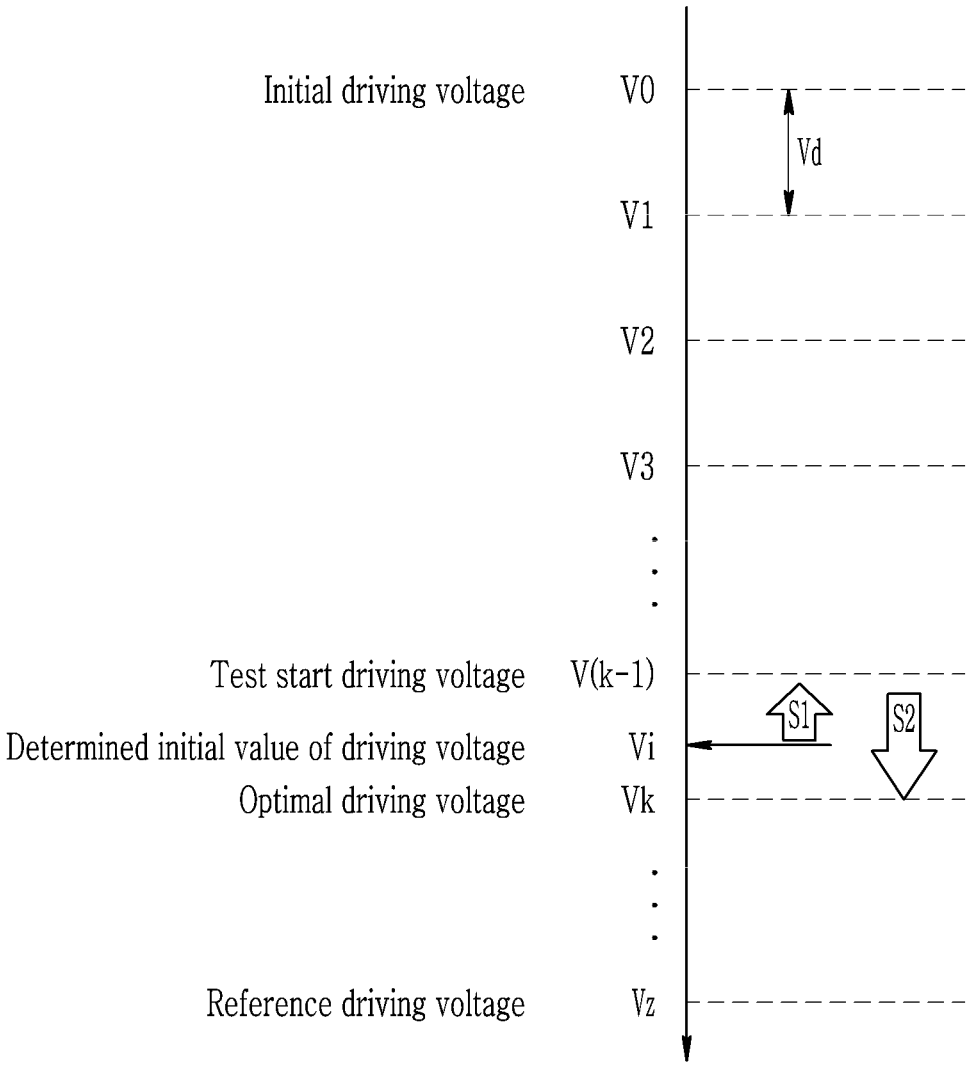
FIG. 8 illustrates a process of determining an optimal driving voltage of a display device according to an exemplary embodiment.

FIG. 3 is a flowchart of a method of setting a driving voltage of a display device according to an exemplary embodiment. FIG. 4 is a graph of luminance efficiency for a red color coordinate according to an exemplary embodiment. FIG. 5 illustrates a graph of luminance efficiency for a green color coordinate according to an exemplary embodiment. FIG. 6 illustrates a graph of luminance efficiency for a blue color coordinate according to an exemplary embodiment. FIG. 7 is a relationship graph between luminance efficiency and driving voltages according to an exemplary embodiment. FIG. 8 illustrates a process of determining an optimal driving voltage of a display device according to an exemplary embodiment.

Referring to FIG. 3, in a manufacturing process of a display device, power is supplied to the display device, a predetermined level of data voltage is applied to the plurality of pixels PX to emit light, and luminance of the display device is measured by using a test device at step S110. The luminance at the center of a screen of the display device, for example, may be measured by using a luminance meter, a camera, and the like capable of measuring the luminance of the display device. By measuring the luminance of the display device, a red color coordinate, a green color coordinate, and a blue color coordinate of an image currently displayed on the display device may be obtained.

At step S120, luminance efficiency with respect to a single color coordinate of one of the primary colors of the display device is determined. More particularly, luminance efficiency for one of the red color coordinate, the green color coordinate, and the blue color coordinate may be determined. As used herein, the luminance efficiency may refer to a ratio of luminance of the display device with respect to a current of a power source provided to the display device. A value of the current of the power source provided to the display device may be obtained by measuring the current of the power source provided to the display device from the power supply 500, or may be a predetermined value since a predetermined power source is used in the manufacturing process of the display device. Luminance efficiency for the red color coordinate may be determined by using a luminance efficiency curve of red (see FIG. 4) prepared in advance. In addition, luminance efficiency for the green color coordinate may be determined by using a luminance efficiency curve of green (see FIG. 5) prepared in advance. Moreover, luminance efficiency for the blue color coordinate may be determined by using a luminance efficiency curve of blue (see FIG. 6) prepared in advance.

Referring to FIG. 4, the luminance efficiency of the red color coordinate Rx may be measured from a plurality of display devices, and generate the luminance efficiency curve of red by using the measured luminance efficiency. In the graph of FIG. 4, a horizontal axis represents the red color coordinate Rx, and a vertical axis represents the luminance efficiency. A unit of the luminance efficiency is cd/A. Values of the luminance efficiency corresponding to the red color coordinate Rx obtained by measuring the luminance of the display device may be determined from the luminance efficiency curve of red.

Referring to FIG. 5, the luminance efficiency of the green color coordinate Rx may be measured from a plurality of display devices, and generate the luminance efficiency curve of green by using the measured luminance efficiency. In the graph of FIG. 5, a horizontal axis represents a green color coordinate Gx, and a vertical axis represents the luminance efficiency. Values of the luminance efficiency corresponding to the green color coordinate Gx obtained by measuring the luminance of the display device may be determined from the luminance efficiency curve of green.

Referring to FIG. 6, the luminance efficiency of the blue color coordinate By may be measured from a plurality of display devices, and generate the luminance efficiency curve of blue by using the measured luminance efficiency. In the graph of FIG. 6, a horizontal axis represents a blue color coordinate By, and a vertical axis represents the luminance efficiency. Values of the luminance efficiency corresponding to the blue color coordinate By obtained by measuring the luminance of the display device may be determined from the luminance efficiency curve of blue.

Referring back to FIG. 3, at step S130, an initial value of the driving voltage for one of the luminance efficiency with respect to the red color coordinate Rx, the green color coordinate Gx, and the blue color coordinate By is determined.

Hereinafter, a relationship between the driving voltage and the luminance efficiency with respect to the blue color coordinate By will be described as an example. In addition, it is assumed a driving voltage to be adjusted is the second power voltage ELVSS, and the first power voltage ELVDD is fixed to a predetermined voltage. In some exemplary embodiments, the driving voltage to be adjusted may alternatively be the first power voltage ELVDD, and the second power voltage ELVSS may be fixed to a predetermined voltage.

A relationship between the driving voltage and the luminance efficiency is obtained by actually measuring a voltage value set as the optimal second power voltage ELVSS for a plurality of display devices, and analyzing a relationship between the actually measured second power voltage ELVSS and the luminance efficiency.

A driving voltage linear relationship shown in FIG. 7 may be derived from the relationship between the voltage value set as the optimal second power voltage ELVSS for a plurality of display devices, and the luminance efficiency of blue of a corresponding display device. The driving voltage linear relationship represents a relationship of the driving voltage with respect to the luminance efficiency. In the graph of FIG. 7, a horizontal axis represents the luminance efficiency of blue, and a vertical axis represents the driving voltages, that is, the values of the second power voltage ELVSS. The value of the second power voltage ELVSS linearly increases as the luminance efficiency of blue increases, and the value of the second power voltage ELVSS linearly decreases as the luminance efficiency of blue decreases.

The initial value of the second power voltage ELVSS, which corresponds to the value of the luminance efficiency determined from the luminance efficiency curve of blue, may be determined from the driving voltage linear relationship. For example, when the luminance efficiency is determined to be 6 cd/A from the luminance efficiency curve of blue of FIG. 6, the initial value of the second power voltage ELVSS may be calculated to be approximately −2.79 V from the driving voltage linear relationship of FIG. 7.

Next, at step S140, an optimal driving voltage of the display device is determined by using the determined initial value of the driving voltage. As used herein, an optimal driving voltage of the display device may refer to a driving voltage at which the display device may realize accurate luminance and color corresponding to the input data voltage. For example, when the data voltage corresponding to white is applied to the display device, the value of the second power voltage ELVSS may be an optimal driving voltage that allows a display device to display white in association with a fixed first power voltage ELVDD. A method of determining the optimal driving voltage of the display device by using the determined initial value of the driving voltage will be described with reference to FIG. 8.

Referring to FIG. 8, a range to which the second power voltage ELVSS of the display device may be adjusted is set from an initial driving voltage V0 to a reference driving voltage Vz, and the second power voltage ELVSS may be adjusted from the initial driving voltage V0 to the reference driving voltage Vz by a unit of an adjustment interval Vd. The adjustment intervals Vd from the initial driving voltage V0 to the reference driving voltage Vz are voltages (V1, V2, V3, . . . , V(k−1), Vk, . . . , Vz) that may be set as the optimal driving voltages. According to exemplary embodiments, the initial driving voltage V0 may be −1.0 V, the reference driving voltage Vz may be −6.0 V, and the adjustment interval Vd may be 0.2 V or 0.3 V. The second power voltage ELVSS corresponding to the initial driving voltage V0 may be applied to the display device when the luminance of the display device is measured.

A test start driving voltage V(k−1) is determined by using an initial value Vi of the determined driving voltage (S1). The test start driving voltage V(k−1) is set as a value that is one step ahead of the initial value Vi of the driving voltage among the settable (or candidate) voltages (V0, V1, V2, V3, . . . , V(k−1), Vk, . . . , Vz). That is, among the settable voltages (V0, V1, V2, V3, . . . , V(k−1)) that are greater than the initial value Vi of the drive voltage, the settable voltage V(k−1) closest to the initial value Vi of the driving voltage may be determined as the test start driving voltage V(k−1). For example, when the initial value Vi of the driving voltage is −2.79 V and the adjustment interval Vd is 0.2 V, the test start driving voltage V(k−1) is −2.6 V, which is greater than the initial value Vi of the driving voltage.

In some exemplary embodiments, among the settable voltages (V0, V1, V2, V3, . . . , V(k−1), Vk, . . . , Vz), the voltage closest to the initial value Vi of the driving voltage may be set as the test start drive voltage. For example, when the initial value Vi of the driving voltage is −2.79 V and the adjustment interval Vd is 0.2 V, the test start driving voltage may be determined to be −2.8 V that is closest to the initial value Vi of the drive voltage.

The luminance of the display device is measured while adjusting the second power voltage ELVSS from the test start driving voltage V(k−1) by a unit of the adjustment interval Vd to find the optimal driving voltage Vk of the display device (S2). The applied second power voltage ELVSS may be determined as the optimal driving voltage Vk of the display device when the accurate luminance and color are realized corresponding to the data voltage input to the display device. The determined optimal driving voltage Vk may be set as the driving voltage of the display device.

When the optimal driving voltage Vk is searched from the initial driving voltage (V0) without determining the test start driving voltage V(k−1), the second power voltage ELVSS should be adjusted for a greater number of times from the initial driving voltage (V0) to the optimal driving voltage Vk by a unit of the adjustment interval Vd, and the luminance of the display device should be measured accordingly, as compared to those using the test start driving voltage V(k−1) according to an exemplary embodiment of the present invention. That is, the test time for setting the driving voltage of the display device may be longer.

However, as in the exemplary embodiment of the present invention, the number of searches for the optimal driving voltage Vk may be reduced by determining the test start driving voltage V(k−1) for each display device, and then finding the optimal driving voltage Vk from the test start driving voltage V(k−1). Therefore, the test time for setting the driving voltage of the display device may be reduced, which may increase the productivity of the display device.

Hereinafter, referring to FIG. 9, a method of setting a driving voltage of a display device according to another exemplary embodiment will be described. The method illustrated in FIG. 9 will be described with focus on the differences of that described in FIG. 1 to FIG. 8 above, and thus, some of the duplicate descriptions thereof will be omitted to avoid redundancy.

Figure 9:
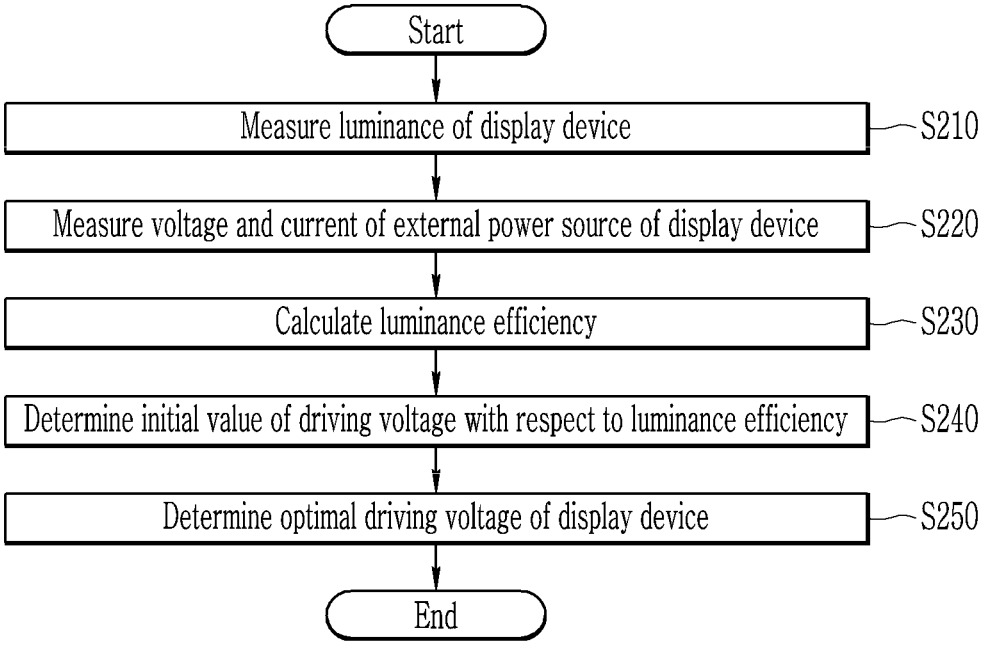
FIG. 9 is a flowchart of a method of setting a driving voltage of a display device according to another exemplary embodiment.

FIG. 9 is a flowchart of a method of setting a driving voltage of a display device according to another exemplary embodiment of the present invention.

Referring to FIG. 9, at step S110, the luminance of the display device is measured by using the test device.

At step S220, the voltage and the current of the external power supply supplying power to the display device are measured. The external power supply of the display device may be the battery 510 of the power supply 500. That is, the voltage and current outputted from the battery 510 may be measured. In some exemplary embodiments, the voltage and current of the AC power input to the converter 520 may be measured.

At step S230, the luminance efficiency of the display device is calculated by using the measured luminance of the display device and the measured voltage and current of the battery 510. The luminance efficiency of the display device may be calculated by Equation 1, which is a luminance efficiency calculation equation.

$$Eff = \frac{Lum}{Ibat \times Vbat \times Ceff \div Vz} \quad \text{(Equation 1)}$$

In Equation 1, "Eff" denotes luminance efficiency, "Lum" denotes measured luminance, "Ibat" denotes a current of the battery 510, "Vbat" denotes a voltage of the battery 510, "Ceff" denotes conversion efficiency of the converter 520, and "Vz" denotes a reference driving voltage.

The conversion efficiency Ceff of the converter 520 and the reference driving voltage Vz may be predetermined values. The product of the current Ibat of the battery 510, the voltage Vbat of the battery 510, and the conversion efficiency Ceff of the converter 520 correspond to electric power provided to the display device, and the value obtained by dividing the electric power provided to the display device by the reference drive voltage Vz corresponds to an amount of current provided to the display device. That is, the luminance efficiency of the display device may be a ratio of the luminance of the display device to the current provided to the display device. The luminance efficiency of the display device may be calculated by applying the measured luminance of the display device, and the measured voltage and current of the battery 510 in Equation 1.

At step 240, the initial value of the driving voltage with respect to the calculated luminance efficiency is determined. In the step of determining the initial value of the driving voltage with respect to the luminance efficiency, the initial value of the driving voltage may be determined from the corresponding to the luminance efficiency, which is calculated by using the driving voltage linear relationship for the luminance efficiency, as described above with reference to FIG. 3 and FIG. 7. In this case, the driving voltage linear relationship is obtained by actually measuring the voltage value set as the optimal second power voltage ELVSS for the plurality of display devices, and analyzing the relationship between the actually measured second power voltage ELVSS and the luminance efficiency calculated by Equation 1 (e.g., the luminance efficiency calculation equation).

At step S250, the optimal driving voltage of the display device is determined by using the determined initial value of the driving voltage. The method of determining the optimal driving voltage of the display device may be performed in the manner described above with reference to FIG. 8.

According to the exemplary embodiment of the present invention, it is possible to reduce a test time for setting an optimal driving voltage of the display device by estimating a test start driving voltage for each display device and performing a process of setting the driving voltage from the test start driving voltage, thereby improving the productivity of the display device.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A method of setting a driving voltage of a display device, comprising:

measuring luminance of the display device;

obtaining a color coordinate from the luminance of the display device and determining luminance efficiency with respect to the color coordinate;

determining an initial value of the driving voltage with respect to the determined luminance efficiency from a driving voltage linear relationship, in which the driving voltage linearly increases as the luminance efficiency increases along the entire luminance efficiency; and determining an optimal driving voltage of the display device by using the determined initial value of the driving voltage.

2. The method of claim 1, wherein the color coordinate is one of primary colors of the display device.

3. The method of claim 1, wherein the luminance efficiency is a ratio of the luminance of the display device to a current provided to the display device.

4. The method of claim 1, wherein the step of determining the luminance efficiency with respect to the color coordinate comprises determining a value of luminance efficiency in a luminance efficiency curve of the color coordinate as the luminance efficiency, the value of luminance efficiency corresponding to the obtained color coordinate.

5. The method of claim 1, wherein the step of determining the optimal driving voltage of the display device comprises:

determining a test start driving voltage by using the determined initial value of the driving voltage; and searching the optimal driving voltage of the display device by measuring the luminance of the display device while adjusting the driving voltage applied to the display device from the test start driving voltage by a unit of an adjustment interval.

6. The method of claim 5, wherein:

one of a plurality of candidate voltages that are settable as the optimal driving voltage is selected as the test start driving voltage; and the selected test start driving voltage is greater than the initial value of the driving voltage and closest to the initial value of the driving voltage.

7. The method of claim 5, wherein:

one of a plurality of candidate voltages that are settable as the optimal driving voltage is selected as the test start driving voltage; and the selected test start driving voltage is closest to the initial value of the driving voltage.

8. The method of claim 1, wherein:

the display device comprises a light-emitting diode configured to be applied with a first power voltage of a high level and a second power voltage of a low level; and the optimal driving voltage of the display device is the second power voltage.

9. A method of setting a driving voltage of a display device, comprising:

measuring luminance of the display device;

measuring a voltage and a current of an external power source supplying power to the display device;

calculating luminance efficiency by using the measured luminance and the measured voltage and current;

determining an initial value of the driving voltage with respect to the calculated luminance efficiency;

determining a test start driving voltage by using the determined initial value of the driving voltage; and searching an optimal driving voltage of the display device by measuring the luminance of the display device while adjusting the driving voltage applied to the display device from the test start driving voltage by a unit of an adjustment interval, wherein an absolute value of the unit of an adjustment interval is greater than an absolute value of a difference between the determined initial value and the test start driving voltage.

10. The method of claim 9, wherein the step of measuring the voltage and current of the external power source comprises measuring a voltage and a current output from a battery of the display device.

11. The method of 10, wherein the luminance efficiency is a ratio of the luminance of the display device to a current provided to the display device.

12. The method of claim 9, wherein the step of determining the initial value of the driving voltage with respect to the calculated luminance efficiency comprises determining the initial value of the driving voltage corresponding to the calculated luminance efficiency from a driving voltage linear relationship, in which the driving voltage linearly increases as the luminance efficiency increases.

13. The method of claim 9, wherein:

one of a plurality of candidate voltages that are settable as the optimal driving voltage is selected as the test start driving voltage; and the selected test start driving voltage is greater than the initial value of the driving voltage and closest to the initial value of the driving voltage.

14. The method of claim 9, wherein:

one of a plurality of candidate voltages that are settable as the optimal driving voltage is selected as the test start driving voltage; and the selected test start driving voltage is closest to the initial value of the driving voltage.

15. The method of claim 9, wherein:

the display device comprises a light-emitting diode configured to be applied with a first power voltage of a high level and a second power voltage of a low level; and the optimal driving voltage of the display device is the second power voltage.

16. A method of setting a driving voltage of a display device, comprising:

determining an initial value of the driving voltage with respect to luminance efficiency, the luminance efficiency being a ratio of luminance of the display device to a current provided to the display device;

determining a test start driving voltage by using the determined initial value of the driving voltage, the test start driving voltage is determined as a value closest to the initial value of the driving voltage among settable voltages; and searching an optimal driving voltage of the display device by measuring the luminance of the display device while adjusting the driving voltage applied to the display device from the test start driving voltage different from the initial value of the driving voltage by a unit of an adjustment interval.

17. The method of claim 16, further comprising:

measuring luminance of the display device; and obtaining a color coordinate from the luminance of the display device and determining the luminance efficiency with respect to the color coordinate.

18. The method of claim 16, further comprising:

measuring luminance of the display device;

measuring a voltage and a current of an external power source supplying power to the display device; and calculating the luminance efficiency by using the measured luminance, voltage, and current.

* * * * *